US007997908B2

(12) United States Patent
Murr et al.

(10) Patent No.: US 7,997,908 B2
(45) Date of Patent: Aug. 16, 2011

(54) SUPPORT MEMBER FOR SUPPORTING AN ELECTRICAL CONNECTOR ON A PRINTED CIRCUIT

(75) Inventors: Keith McQuilkin Murr, York, PA (US); Jordan M. Cole, San Jose, CA (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/576,981

(22) Filed: Oct. 9, 2009

(65) Prior Publication Data

US 2011/0086522 A1 Apr. 14, 2011

(51) Int. Cl.
*H01R 12/00* (2006.01)

(52) U.S. Cl. ..... 439/76.1

(58) Field of Classification Search ..... 439/76.1, 439/79, 540.3, 541.5; 361/752, 736
See application file for complete search history.

(56) References Cited

U.S. PATENT DOCUMENTS 4,952,172 A * 8/1990 Barkus et al. ..... 439/532
5,104,341 A * 4/1992 Gilissen et al. ..... 439/607.4
5,184,961 A * 2/1993 Ramirez et al. ..... 439/59
5,639,250 A * 6/1997 Neef et al. ..... 439/79
6,123,554 A * 9/2000 Ortega et al. ..... 439/79
6,315,605 B1 * 11/2001 Billman et al. ..... 439/540.1
6,392,895 B2 * 5/2002 Taguchi et al. ..... 361/752
6,643,143 B1 * 11/2003 Stewart et al. ..... 361/828
6,997,736 B2 * 2/2006 Costello et al. ..... 439/378
7,175,447 B2 * 2/2007 Pan ..... 439/79
7,320,609 B1 * 1/2008 Minich ..... 439/79
7,549,897 B2 * 6/2009 Fedder et al. ..... 439/751
7,607,939 B2 * 10/2009 Moriyama et al. ..... 439/541.5

* cited by examiner

*Primary Examiner* — T C Patel
*Assistant Examiner* — Harshad C Patel

(57) ABSTRACT

A connector assembly includes a printed circuit having a component surface, and an electrical connector having a bottom side mounted on the component surface of the printed circuit. The electrical connector extends a length from a mating face to a rear side that is opposite the mating face. The electrical connector is configured to mate with a mating connector at the mating face. The assembly includes a support member that includes a body having a connector face and a circuit face. The support member is positioned such that the connector face engages the rear side of the electrical connector and the circuit face engages the component surface of the printed circuit to support the electrical connector on the printed circuit.

10 Claims, 11 Drawing Sheets

SUPPORT MEMBER FOR SUPPORTING AN ELECTRICAL CONNECTOR ON A PRINTED CIRCUIT

BACKGROUND OF THE INVENTION

The subject matter described and/or illustrated herein relates generally to electrical connectors, and more particularly, to electrical connectors that are mounted on printed circuits.

Electrical connectors are commonly used to interconnect a wide variety of electrical components. Some electrical connectors are mounted on printed circuits (sometimes referred to as "circuit boards") for electrically connecting the printed circuit to another electrical component via a mating connector of the other electrical component. When the electrical connector is mated with the mating connector of the other electrical component, the printed circuit may flex and/or experience stress. For example, an insertion force required to mate the connectors together may stress the printed circuit and/or cause the printed circuit to flex during mating of the connectors. The flexing of, and/or the stresses applied to, the printed circuit may damage the printed circuit, for example causing the printed circuit to fracture, crack, and/or non-elastically deform. Flexing of the printed circuit can also dislodge the electrical connector from the printed circuit, possibly breaking one or more of the electrical connections between the electrical connector and the printed circuit.

Some known electrical connectors and printed circuits are engaged by support members that support the electrical connector and the printed circuit during mating with the mating connector. But, known support members extend along one or more sides of the electrical connector. Such known support members thereby occupy space within a mating area of the printed circuit along which the electrical connector is mounted. Mounting support members along the side of an electrical connector is an inefficient use of the limited space of the mating area of the printed circuit. For example, mounting support members along the side of an electrical connector may limit the overall number and/or size of electrical connectors that can be located along the mating area of the printed circuit.

BRIEF DESCRIPTION OF THE INVENTION

In one embodiment, a connector assembly includes a printed circuit having a component surface, and an electrical connector having a bottom side mounted on the component surface of the printed circuit. The electrical connector extends a length from a mating face to a rear side that is opposite the mating face. The electrical connector is configured to mate with a mating connector at the mating face. The assembly includes a support member that includes a body having a connector face and a circuit face. The support member is positioned such that the connector face engages the rear side of the electrical connector and the circuit face engages the component surface of the printed circuit to support the electrical connector on the printed circuit.

In another embodiment, a connector assembly includes a printed circuit having a component surface, a housing covering at least a portion of printed circuit, and an electrical connector having a bottom side mounted on the component surface of the printed circuit. The electrical connector includes a rear side extending from the bottom side. The assembly includes a support member that includes a body having a connector face and a circuit face. The support member is positioned such that the connector face engages the rear side of the connector and the circuit face engages the component surface of the printed circuit to support the electrical connector on the printed circuit.

In another embodiment, a connector assembly is provided for mounting on a printed circuit having a component surface. The assembly includes an electrical connector having a bottom side configured to be mounted on the component surface of the printed circuit. The electrical connector extends a length from a mating face to a rear side that is opposite the mating face. The electrical connector is configured to mate with a mating connector at the mating face. The assembly also includes a support member including a body having a connector face and a circuit face. The connector face is configured to engage the rear side of the electrical connector. The circuit face is oriented relative to the connector face such that the circuit face is positioned to engage the component surface of the printed circuit when the connector face is engaged with the electrical connector and the electrical connector is mounted on the printed circuit.

DETAILED DESCRIPTION OF THE INVENTION

Figure 1:
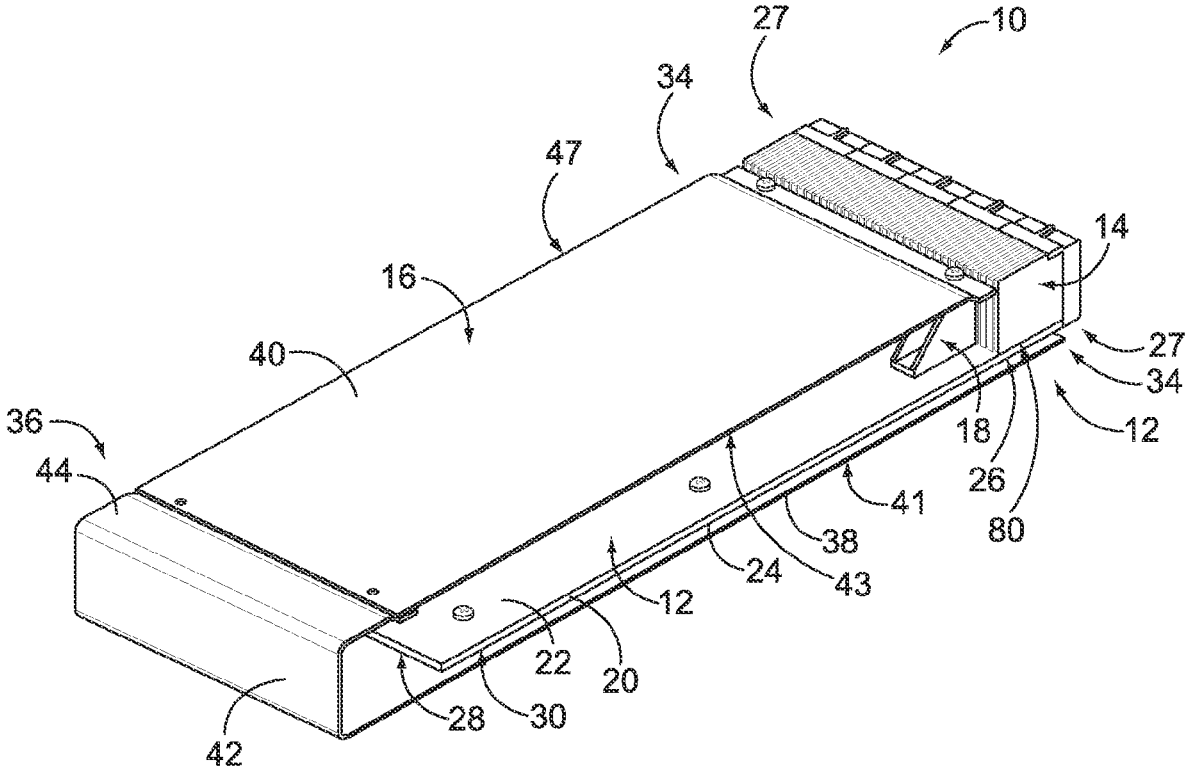
FIG. 1 is a perspective view of an exemplary embodiment of a connector assembly.
Figure 9:
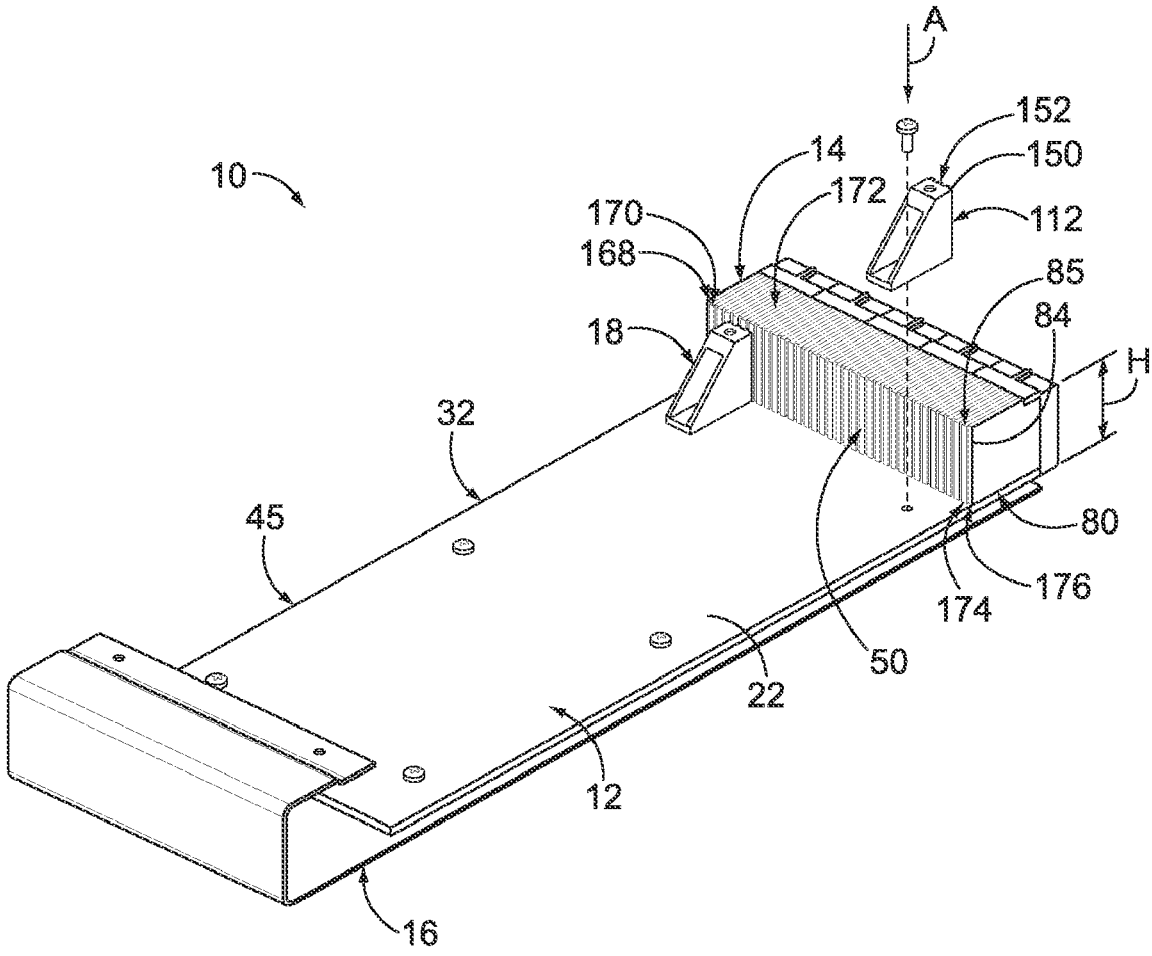
FIG. 9 is a partially exploded perspective view of a portion of the connector assembly shown in FIG. 1.

FIG. 1 is a perspective view of an exemplary embodiment of a connector assembly 10. The assembly 10 includes a printed circuit 12, a plurality of electrical connectors 14, a housing 16, and a plurality of support members 18. The printed circuit 12 includes a substrate 20 having a component surface 22 and a bottom surface 24 that is opposite the component surface 22. The substrate 20 of the printed circuit 12 extends a length from a mating edge 26 to a mounting edge 28, and extends a width from a side edge 30 to an opposite side edge 32 (FIG. 9). The electrical connectors 14 include bottom sides 80 that are mounted on the component surface 22 of the printed circuit 12, in the exemplary embodiment, along the mating edge 26. The mating edge 26 optionally defines a mating area 27 of the printed circuit 12. The housing 16 extends a length from a connector end 34 to a mounting end 36 that is opposite the connector end 34. The housing 16 includes a wall 38 extending along and covering the bottom surface 24 of the printed circuit 12, a wall 40 extending along and covering the component surface 22 of the printed circuit 12, and a rear wall 42 that intersects the walls 38 and 40. In the exemplary embodiment, the rear wall 42 extends integrally from the wall 38 and includes a flange 44 along which the rear wall 42 is connected to the wall 40. The housing 16 may be referred to herein as an "assembly housing".

As will be described below, the support members 18 are positioned relative to the electrical connectors 14 and the printed circuit 12 such that the support members 18 engage the electrical connectors 14 and the printed circuit 12 to support the electrical connectors 14 on the printed circuit 12. The connector assembly 10 may be, but is not limited to being, a backplane connector assembly. In some embodiments, the mounting end 36 of the housing 16 is mounted on, and/or connected to, another structure (such as, but not limited to, a panel, a rack, a wall, and/or the like) of a larger system of which the connector assembly 10 is a component.

As used herein, the term "printed circuit" is intended to mean any electric circuit in which the conducting connections have been printed or otherwise deposited in predetermined patterns on an electrically insulating substrate. In the exemplary embodiment, each of the component surface 22 and the bottom surface 24 of the printed circuit substrate 20 include electrical conductors (not shown, such as, but not limited to, electrical contacts, electrical traces, electrical vias, and/or the like) thereon. Each of the electrical conductors on the surface 22 and the surface 24 may conduct electrical signals, electrical ground, and/or electrical power. At least some of the electrical conductors are provided along the mating edge 26 of the printed circuit 12. Alternatively, only one of the surfaces 22 and 24 includes the electrical conductors thereon. Electrical conductors on the component surface 22 may be electrically connected to the electrical conductors on the bottom surface 22 via corresponding electrical vias (not shown) and/or electrical traces (not shown) that extend through the substrate 20, and/or vice versa.

The geometry, size, shape, and/or the like of the printed circuit 12 shown and/or described herein is meant as exemplary only. In addition or alternative to what is shown and described herein, the printed circuit 12 may include other geometries, shapes, sizes, and/or the like. For example, although shown as having an approximately rectangular shape, the printed circuit 12 may additionally or alternatively include a circular shape, a triangular shape, and oval shape, and/or the like.

The substrate 20 of the printed circuit 12 may be a flexible substrate or a rigid substrate. The substrate 20 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 20 is a rigid substrate fabricated from epoxy-glass, such that the printed circuit 12 is what is sometimes referred to as a "circuit board". In the exemplary embodiment, the substrate 20 includes only a single layer. Alternatively, the substrate 20 may include any number of layers greater than one layer. For example, the substrate 20 may include two exterior layers that each defines one of the surfaces 22 and 24, with one or more interior layers sandwiched between the exterior layers. Each interior layer of the substrate 20 may include electrical conductors thereon. Each electrical conductor on interior layers of the substrate 20 may conduct electrical signals, electrical ground, and/or electrical power. The electrical conductors on interior layers of the substrate 20 may electrically connect some or all of the electrical conductors on the surface 22 with one or more electrical conductors on the surface 24. In addition or alternatively, the electrical conductors on interior layers of the substrate 20 may electrically connect some or all of the electrical conductors on the surface 22 and/or the surface 24 to any other location on and/or within the substrate 20 (such as, but not limited to, any location on any layer, including the same layer, of the substrate 20). Further, and for example, one or more layers of the substrate 20 are optionally, or optionally include, a ground plane.

Although not shown, the substrate 20 may include one or more electrical components (not shown) mounted on the surface 22, the surface 24, and/or an interior layer of the substrate 20. Each of the electrical components may be active or passive. Examples of active electrical components include, but are not limited to, processors, amplifiers, and/or the like. Examples of passive electrical components include, but are not limited to, resistors, capacitors, inductors, diodes, and/or the like. Each of the electrical components may be electrically connected to one or more of the electrical conductors of the substrate 20.

The geometry, size, shape, number of walls, and/or the like of the housing 16 shown and/or described herein is meant as exemplary only. In addition or alternative to what is shown and described herein, the housing 16 may include other geometries, shapes, sizes, number of walls, and/or the like. For example, in some alternative embodiments the housing 16 may include a side wall (not shown) that intersects edges 41 and/or 43 of the walls 38 and 40, respectively, and/or a side wall (not shown) that intersects edges 45 (FIG. 9) and/or 47 of the walls 38 and 40, respectively. The housing 16 may cover any portions of the printed circuit 12. For example, the walls 38, 40, and 42 of the housing 16 may each cover and/or extend along less of the printed circuit 12 than is shown and/or described herein. Moreover, and for example, the walls 38, 40, and 42 of the housing 16 may each cover and/or extend along different portions of the printed circuit 12 than the portions shown and/or described herein. The housing 16 may be fabricated from any materials. In the exemplary embodiment, the housing 16 is fabricated from one or more electrically conductive materials, such as, but not limited to, a metal and/or the like. In addition or alternatively, the housing 16 is fabricated from one or more dielectric materials.

Figure 2:
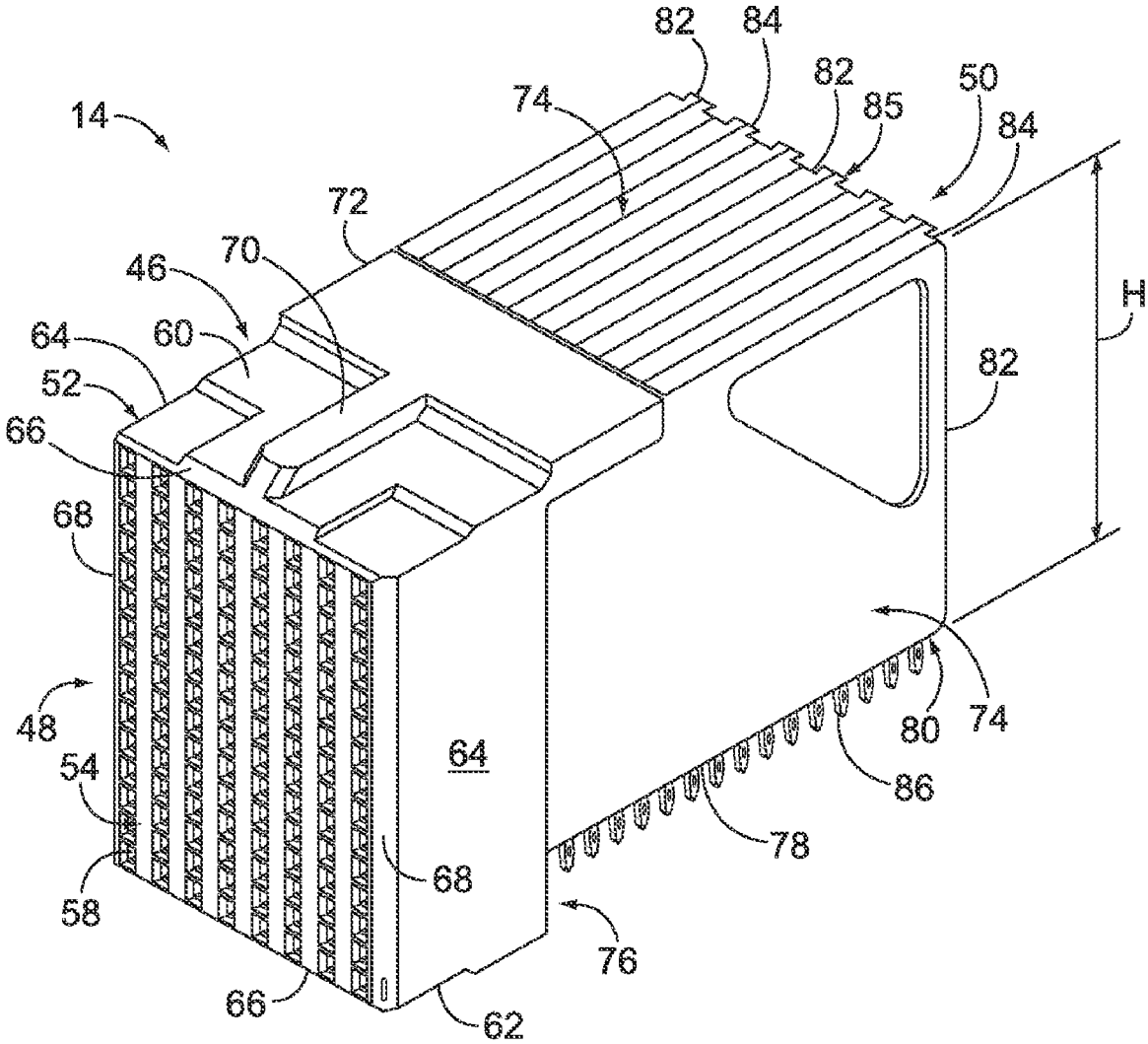
FIG. 2 is a perspective view of an exemplary embodiment of an electrical connector of the connector assembly shown in FIG. 1.

FIG. 2 is a perspective view of an exemplary embodiment of one of the electrical connectors 14. The electrical connector 14 includes a dielectric housing 46. The electrical connector 14 extends a length from a forward mating end 48 of the housing 46 to a rear side 50. The mating end 48 includes a shroud 52 and a mating face 54. The mating face 54 includes a plurality of mating contacts 56 (FIG. 4), such as, for example, contacts within contact cavities 58 that are configured to receive corresponding mating contacts (not shown) from a mating connector (not shown). The shroud 52 includes an upper surface 60 and a lower surface 62 between opposed sides 64. The upper and lower surfaces 60 and 62, respectively, each include an optional chamfered forward edge portion 66. The sides 64 each include optional chamfered side edge portions 68. An optional alignment rib 70 is formed on the upper shroud surface 60 and lower shroud surface 62. The chamfered edge portions 66 and 68 and the alignment rib 70 cooperate to bring the electrical connector 14 into alignment with the mating connector during the mating process so that the contacts in the mating connector are received in the contact cavities 58 without damage. The housing 46 may be referred to herein as a "connector housing".

The housing 46 also includes a rearwardly extending hood 72. A plurality of contact modules 74 are received in the housing 46 from a rear end 76 of the housing 46. Bottom walls 78 of the contact modules 74 define a portion of a bottom side 80 of the electrical connector 14. Rear walls 82 of the contact modules 74 define the rear side 50 of the electrical connector 14. Although twelve are shown, each electrical connector 14 may include any number of the contact modules 74.

The rear side 50 of the electrical connector 14 includes one or more optional slots 84 and one or more optional extension elements 85 for connection with the support member 18. In the exemplary embodiment, each of the slots 84 and each of the extension elements 85 extends along an approximate entirety of the height H of the rear side 50 of the electrical connector 14, which is best seen in FIG. 9. Alternatively, one or more of the slots 84 and/or one or more of the extension elements 85 extends along only a portion of the height H of the rear side 50 of the electrical connector 14. As can be seen in FIG. 2, each of the slots 84 and each of the extension elements 85 is defined by the rear walls 82 of two adjacent contact modules 74. In other words, the rear wall 82 of each contact module 74 includes approximately half of one of the slots 84 and approximately half of one of the extension elements 85. Alternatively, the rear wall 82 of one or more of the contact modules 74 may include one or more entire slots 84 and/or one or more entire extension elements 85 (whether or not the rear wall 82 includes any partial slots 84 and/or partial extension elements 85). Moreover, in some alternative embodiments, the rear wall 82 of one or more of the contact modules 74 includes less and/or more than approximately half of one or more of the slots 84 and/or one or more of the extension elements 85 (whether or not the rear wall 82 includes any entire slots 84 and/or entire extension elements 85).

In the exemplary embodiment, each of the slots 84 and each of the extension elements 85 includes a wedge shape. But, in addition or alternatively to the exemplary shapes shown and/or described herein, each of the slots 84 may include any other shape. Each of the extension elements 85 may also include any other shape than is shown and/or described herein. Although four extension elements 85 are shown, the rear side 50 of each electrical connector 14 may include any number of entire extension elements 85 and any number of partial extension elements 85. Similarly, although three entire slots 84 and two half slots 84 are shown, the rear side 50 of each electrical connector 14 may include any number of entire slots 84 and any number of partial slots 84.

The bottom side 80 of the electrical connector 14 extends from the rear side 50 and includes a plurality of mounting contacts 86 that are configured to be mounted to the printed circuit 12 (FIGS. 1 and 9-11). In the exemplary embodiment, the mounting contacts 86 are press-fit contacts, specifically eye-of-the-needle contacts. One or more of the mounting contacts 86 may alternatively be another type of contact, such as, but not limited to, pin contacts, solder tail contacts, other press-fit contacts, surface mount contacts, and/or the like. In the exemplary embodiment, the bottom side 80 of the electrical connector 14, and thus the component surface of the printed circuit 12, is approximately perpendicular to the mating face 54. The electrical connector 14 thereby interconnects the printed circuit 12 with the mating connector at approximately a right angle relative to each other, in the exemplary embodiment. Alternatively, the bottom side 80 extends at any other angle relative to the mating face 54 for interconnecting the printed circuit 12 with the mating connector at any other angle relative to each other than a right angle, such as, but not limited to, approximately parallel.

Figure 3:
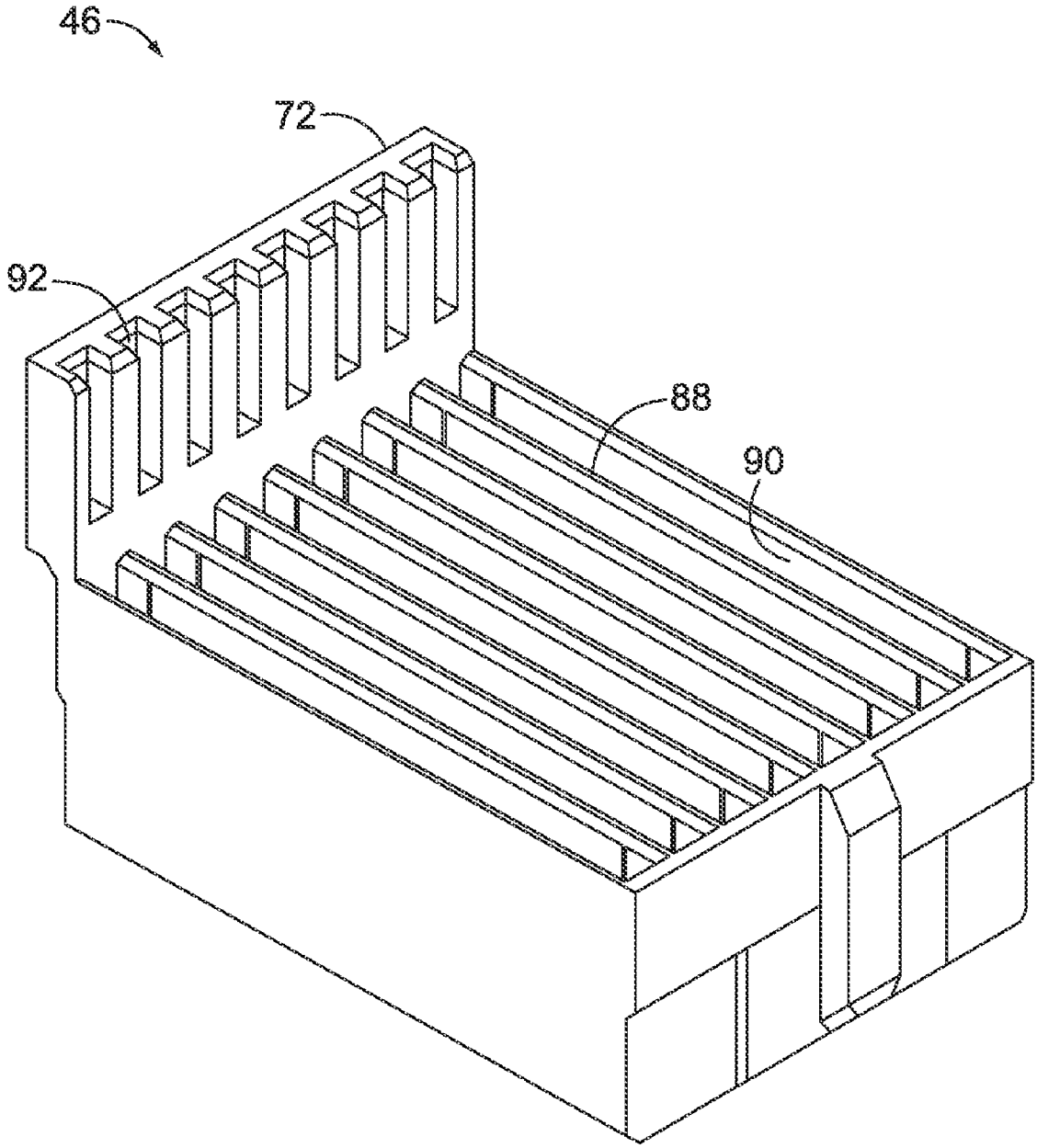
FIG. 3 is a perspective view of an exemplary embodiment of a housing of the electrical connector shown in FIG. 2.

FIG. 3 is a perspective view of an exemplary embodiment of the housing 46 of the electrical connector 14 (FIGS. 1, 2, 9, and 10). The housing 46 includes a plurality of dividing walls 88 that define a plurality of chambers 90. The chambers 90 receive a forward portion of the contact modules 74 (FIGS. 2 and 4) therein. A plurality of slots 92 are formed in the hood 72. The chambers 90 and the slots 92 cooperate to stabilize the contact modules 74 when the contact modules 74 are loaded into the housing 46. In the exemplary embodiment, the slots 92 each have an approximately equal width. However, some or all of the slots 92 may different widths for accommodating differently sized contact modules 74. The chambers 90 and the slots 92 optionally extend substantially an entire length of the contact modules 74 such that the walls 88 separate adjacent contact modules 74.

Figure 4:
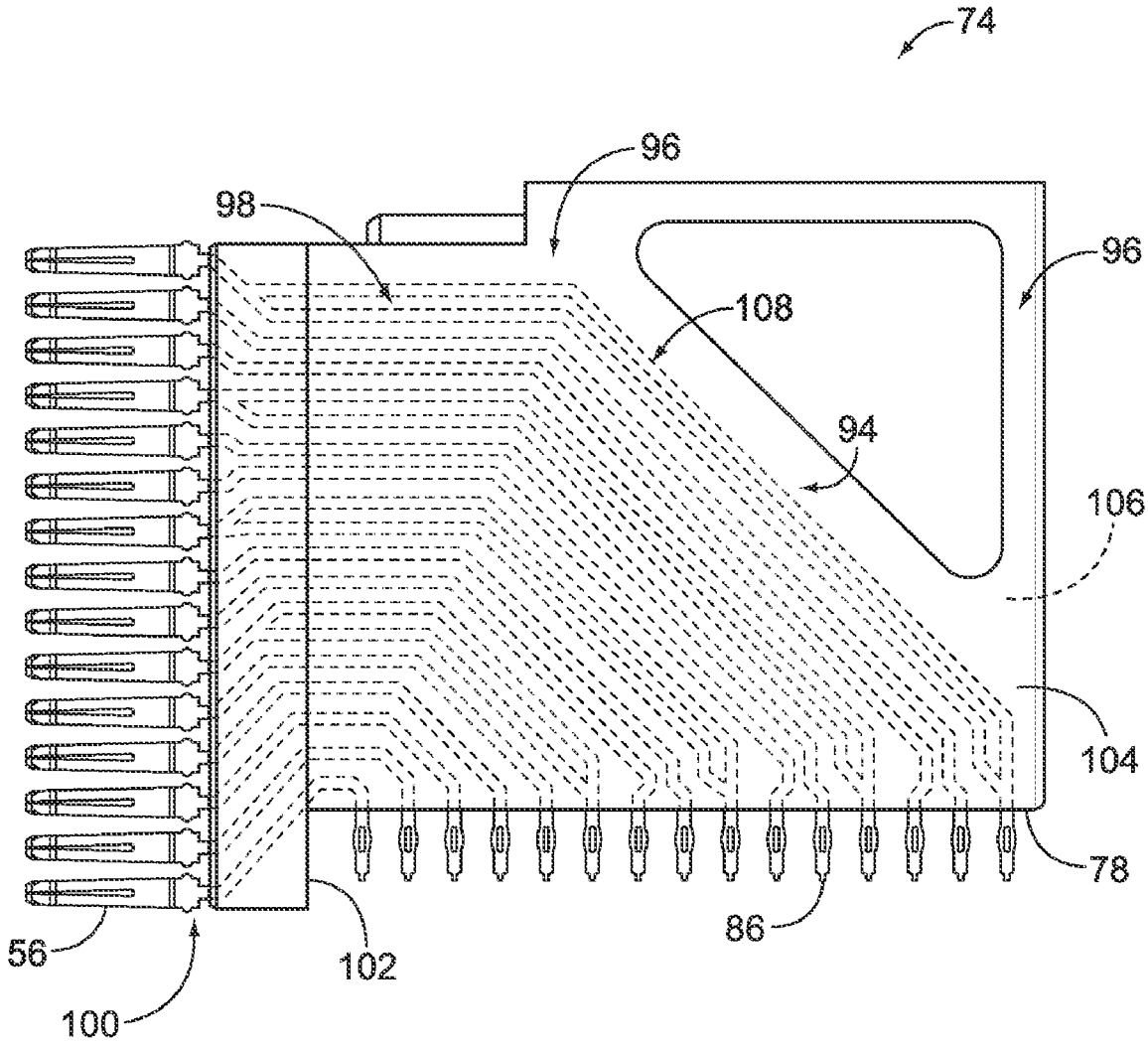
FIG. 4 is a side elevational view of an exemplary embodiment of a contact module of the electrical connector shown in FIG. 2.

FIG. 4 is a side elevational view of an exemplary embodiment of a contact module 74 of the electrical connector 14 (FIGS. 1, 2, 9, and 10). The contact module 74 includes an internal lead frame 94, shown in phantom outline, and a dielectric body 96. The lead frame 94 includes a plurality of terminals 98 enclosed within the body 96. The mating contacts 56 extend from a mating edge portion 100 of the body 96 and the mounting contacts 86 extend from the bottom wall 78 of the body 96. The bottom wall 78 intersects with a rearward facing end wall 102 proximate the mating edge portion 100. Alternatively, the mating edge portion 100 may intersect the bottom wall 78. The body 96 includes opposite sides 104 and 106 that, in the exemplary embodiment, extend substantially parallel to and along the lead frame 94. In the exemplary embodiment, the mating edge portion 100 and the bottom wall 78 extend approximately perpendicular to each other. However, the mating edge portion 100 and the bottom wall 78 may extend any direction relative to each other, such as, but not limited to, approximately parallel.

The terminals 98 include the mating and mounting contacts 56 and 86, respectively, and an intermediate terminal portion 108, which extends between the mating and mounting contacts 56 and 86, respectively. The intermediate terminal portions 108 extend along predetermined paths to electrically connect each mating contact 56 to a corresponding mounting contact 86. In some embodiments, the intermediate terminal portion 108 extends obliquely between the mating and mounting contacts 56 and 86, respectively. For example, in the exemplary embodiment, portions of the intermediate terminal portions 108 extend at approximately a forty-five degree angle between the mating and mounting contacts 56 and 86, respectively.

Each of the terminals 98 of the contact module 74 may transmit electrical signals, electrical power, or electrical ground. The contact module 74 may include any number of terminals 98, any number of which may be selected as electrical signal terminals, electrical power terminals, and electrical ground terminals according the desired wiring pattern of the contact module 74. Optionally, adjacent electrical signal terminals may function as differential pairs, and each differential pair may optionally be separated by an electrical ground terminal. The contact module 74 may include any number of the mating contacts 56 and any number of the mounting contacts 86.

In alternative embodiments, at least a portion of the intermediate terminal portion 108 of one or more of the terminals 98 may be removed such that the intermediate terminal portion 108 does not connect the corresponding mating and mounting contacts 56 and 86, respectively, of the terminal 98. In such an embodiment wherein at least a portion of one or more of the intermediate terminal portions 108 is removed, a commoning member (not shown) may be employed to electrically connect the corresponding mating and mounting contacts 56 and 86, respectively.

Figure 6:
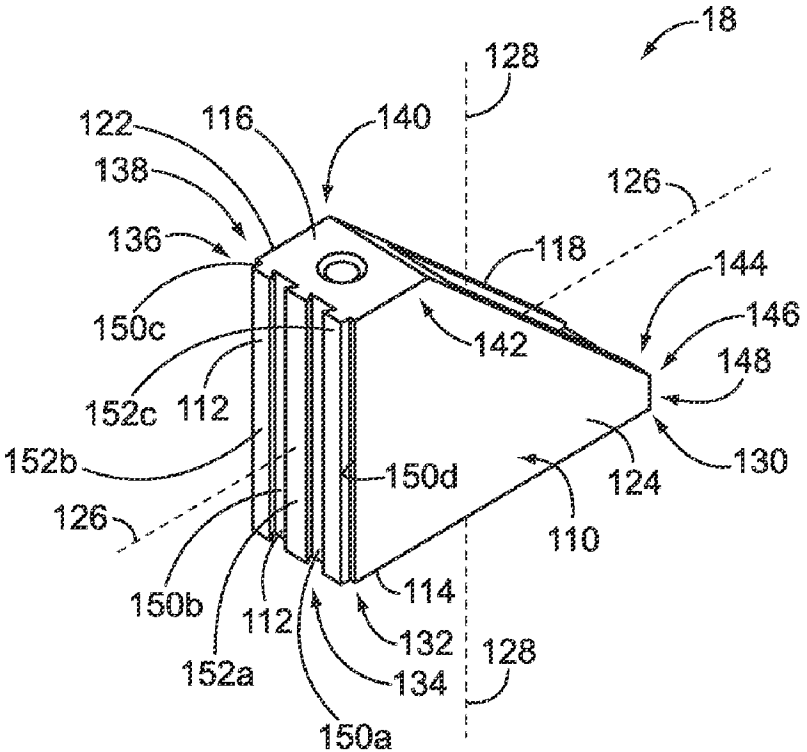
FIG. 6 is another perspective view of the support member shown in FIG. 5 viewed from a different angle than FIG. 5.
Figure 5:
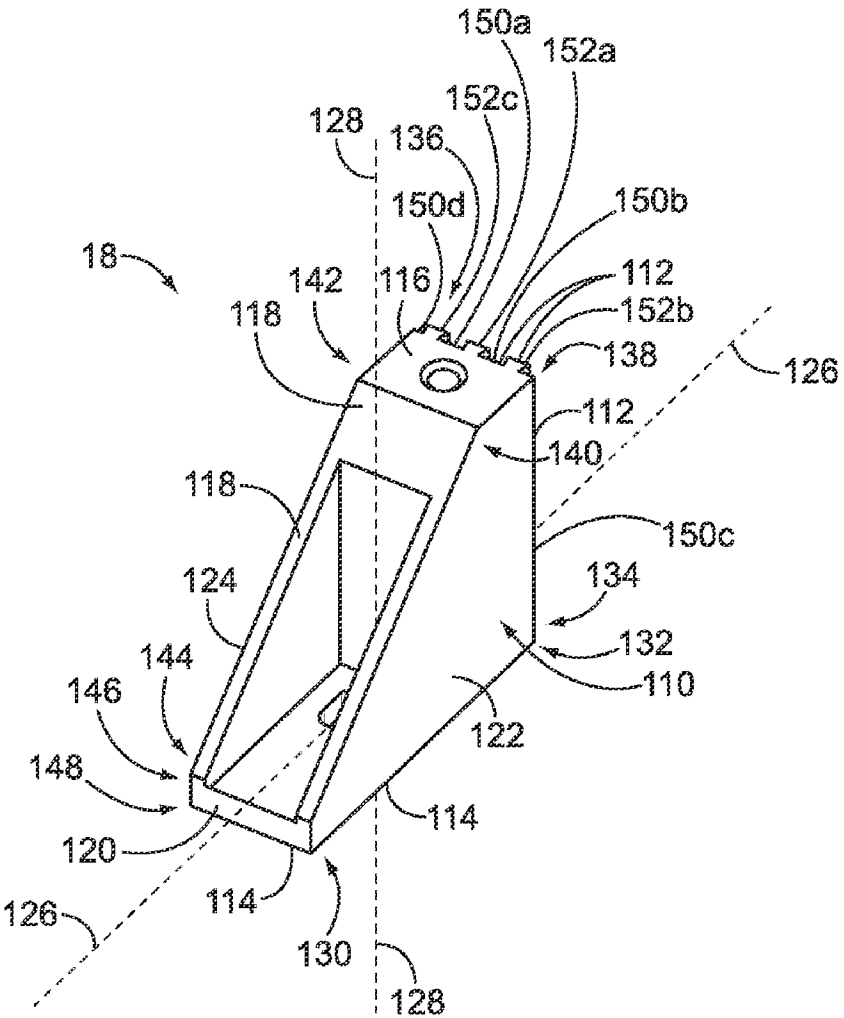
FIG. 5 is a perspective view of an exemplary embodiment of a support member of the connector assembly shown in FIG. 1.

FIG. 5 is a perspective view of an exemplary embodiment of one of the support members 18. FIG. 6 is another perspective view of the support member 18 viewed from a different angle than FIG. 5. Referring now to FIGS. 5 and 6, the support member 18 includes a body 110 having a connector face 112, a circuit face 114, a housing face 116, an intermediate face 118, and a rear face 120. A pair of opposite side faces 122 and 124 extend between the faces 112, 114, 116, 118, and 120 at opposite sides thereof. As will be described below, the connector face 112 is configured to engage the rear side 50 (FIGS. 2, 9, and 10) of the electrical connector 14 (FIGS. 1, 2, 9, and 10), and the circuit face 114 is configured to engage the component surface 22 (FIGS. 1, 9, and 11) of the printed circuit 12 (FIGS. 1, 9, and 11).

The body 110 extends a length along a central longitudinal axis 126, and extends a height along a central axis 128. The circuit face 114 extends a length along the length of the body 110 from an end 130 to an opposite end 132. The connector face 112 extends a length from the end 132 of the circuit face 114 along the height of the body 110. The connector face 112 extends the length from an end 134 that intersects the end 132 of the circuit face 114 to an opposite end 136. In the exemplary embodiment, the lengths of the connector face 112 and the circuit face 114 extend approximately perpendicular to each other. The housing face 116 extends a length from the end 136 of the connector face 112 along a portion of the length of the body 110. The housing face 116 extends the length from an end 138 that intersects the end 136 of the connector face 112 to an opposite end 140. In the exemplary embodiment, the length of the housing face 116 extends approximately perpendicular to the length of the connector face 112 and approximately parallel to the length of the circuit face 114.

The intermediate face 118 extends a length from the housing face 116 to the rear face 120. The intermediate face 118 extends the length from an end 142 that intersects the end 140 of the housing face 116 to an opposite end 144. The rear face 120 extends a length from the end 144 of the intermediate face 118 along the height of the body 110. The rear face 120 extends the length from an end 146 that intersects the end 144 of the intermediate face 118 to an opposite end 148 that intersects the end 130 of the circuit face 114. In the exemplary embodiment, the length of the rear face 120 extends approximately perpendicular to the lengths of the circuit face 114 and the housing face 116, and extends approximately parallel to the length of the connector face 112. In the exemplary embodiment, the length of the intermediate face 118 extends at an approximately 135° angle relative to the housing face 116 and the rear face 120, and thus extends at an approximately 45° angle relative to the connector face 112 and the circuit face 114.

The connector face 112 of the body 110 of the support member 18 includes one or more optional slots 150 for connection with the electrical connector 14. The slots 150 define optional extension elements 152 therebetween. In the exemplary embodiment, the body 110 includes four slots 150, namely, two interior slots 150*a* and 150*b* and two exterior slots 150*c* and 150*d*. The interior slots 150*a* and 150*b* are spaced apart from each other by an extension element 152*a*. The exterior slot 150*c* is spaced apart from the interior slot 150*b* by an extension element 152*b*, and the exterior slot 150*d* is spaced apart from the interior slot 150*a* by an extension element 152*c*. In the exemplary embodiment, each of the slots 150 and each of the extension elements 152 extends along an approximate entirety of the length of the connector face 112. Alternatively, one or more of the slots 150 and/or one or more of the extension elements 152 extends along only a portion of the length of the connector face 112.

In the exemplary embodiment, the interior slots 150*a* and 150*b* each include a wedge shape, while the exterior slots 150*c* and 150*d* each include a right-angle shape. But, in addition or alternatively to the exemplary shapes shown and/or described herein, each of the slots 150 may include any other shape. Each of the extension elements 152 may also include any other shape than is shown and/or described herein. One or more of the slots 150 optionally includes a complementary shape relative to a corresponding one of the extension elements 85 (FIGS. 2, 9, and 10) of the electrical connector 14. Similarly, one or more of the extension elements 152 optionally includes a complementary shape relative to a corresponding one of the slots 84 (FIGS. 2, 9, and 10) of the electrical connector 14. Although four slots 150 and three extension elements 152 are shown, the connector face 112 may include any number of the slots 150 and any number of the extension elements 152.

Figure 7:
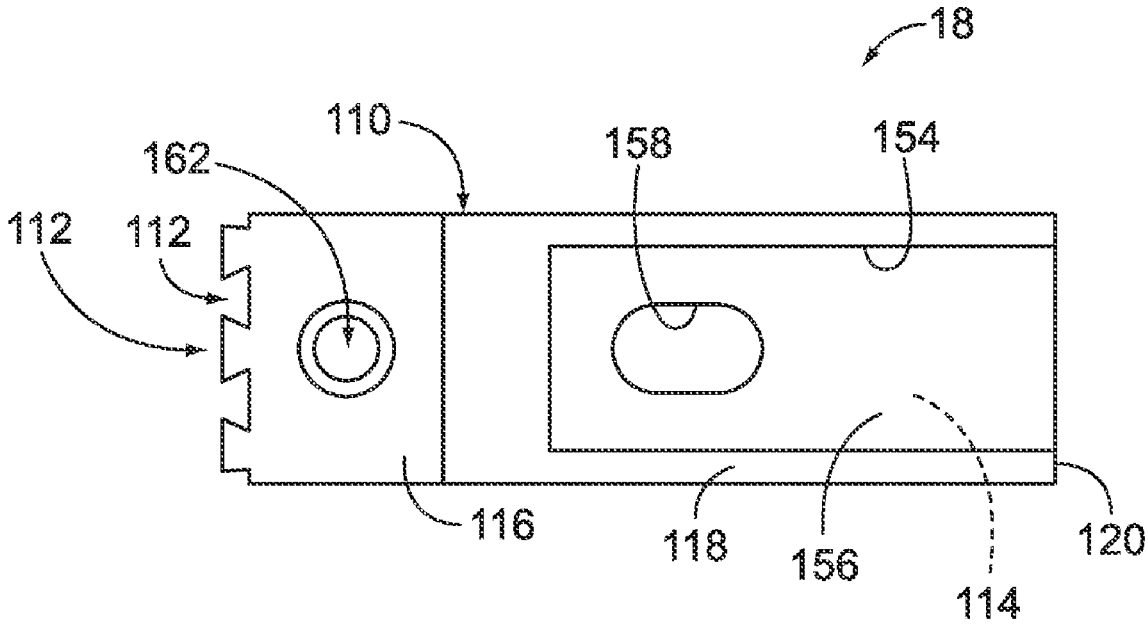
FIG. 7 is a plan view of the support member shown in FIGS. 5 and 6.
Figure 8:
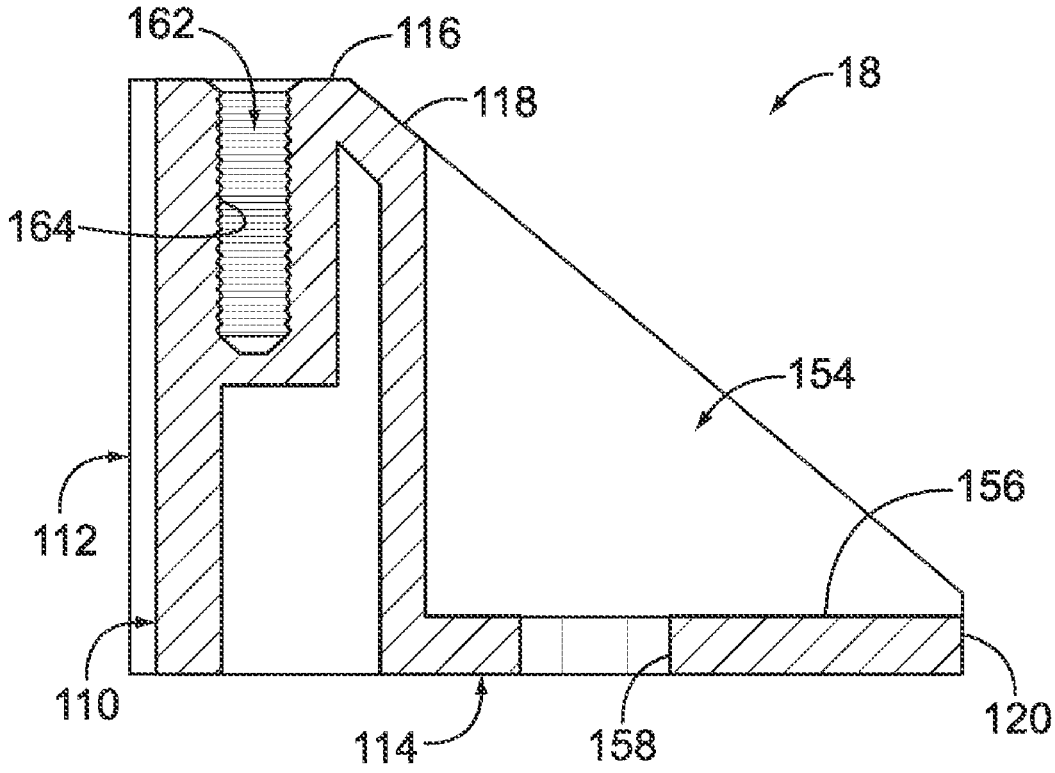
FIG. 8 is a cross-sectional view of the support member shown in FIGS. 5-7.

FIG. 7 is a plan view of the support member 18. FIG. 8 is a cross-sectional view of the support member 18. Referring now to FIGS. 7 and 8, the intermediate face 118 includes an optional recess 154 extending therethrough. The recess 154 optionally extends through a portion of the rear face 120, as best seen in FIG. 5. The recess 154 includes a bottom 156. One or more optional openings 158 extend through the bottom 156 of the recess 154, through the circuit face 114, and completely through the body 110 between the bottom 156 and the circuit face 114. The opening 158 is configured to receive a fastener 160 (FIGS. 10 and 11) therethrough for connecting the support member 18 to the wall 38 (FIGS. 1 and 11) of the housing 16 (FIGS. 1, 9, 11, and 12) of the electrical connector 14. Optionally, the body 110 of the support member 18 does not include the recess 154 and the opening 158 extends through the intermediate face 118.

Figure 12:
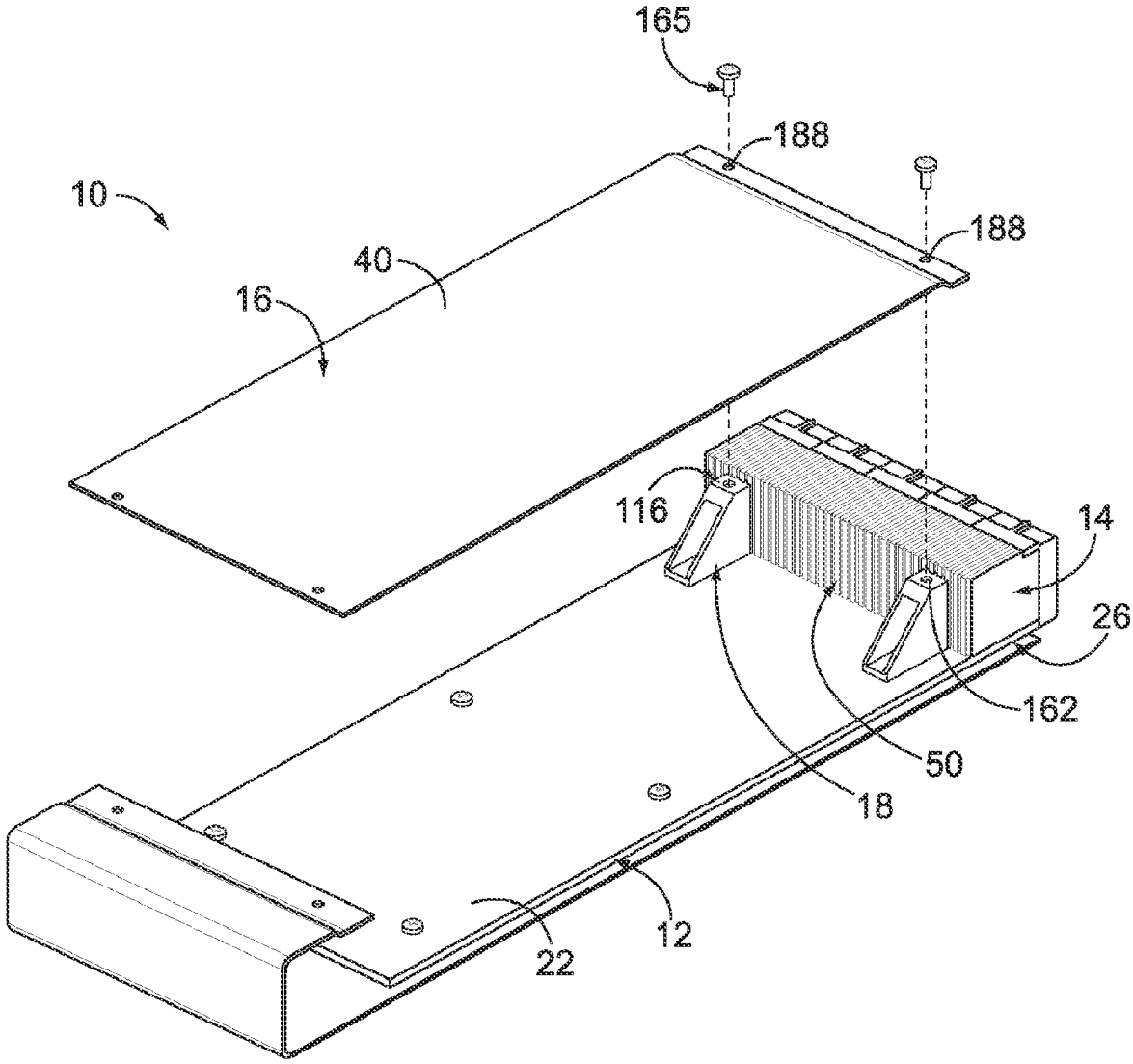
FIG. 12 is a partially exploded perspective view of the connector assembly shown in FIG. 1.

The support member 18 includes one or more optional openings 162 that extend through the housing face 116 and into a portion of the body 110. In the exemplary embodiment, the opening 162 includes a thread 164 for connection to the housing 16 using a threaded fastener 165 (FIG. 12). In some alternative embodiments, the opening 162 extends completely through the body 110 for connecting the support member 18 to the wall 38 of the housing 16 using a fastener (not shown) that extends through the opening 162. The connection between the support member 18 and the wall 38 of the housing 16 using the opening 162 may be an additional or alternative connection to any connection between the support member 18 and the wall 38 described and/or illustrated herein, such as, but not limited to, to the connection between the support member 18 and the wall 38 using the opening 158.

In addition or alternatively to the exemplary sizes and shapes shown and/or described herein, the body 110 of the support member 18 may include any other shapes that enable the body 110 to engage both the component surface 22 (FIGS. 1, 9, and 11) of the printed circuit 12 and the rear side 50 of the electrical connector 14. For example, the lengths of the connector face 112 and the circuit face 114 may extend at any other angle than approximately perpendicular relative to each other. Moreover, and for example, the length of the housing face 116 may extend at any other angle than approximately perpendicular relative to the length of the connector face 112; and the length of the housing face 116 may extend at any other angle than approximately parallel relative to the length of the circuit face 114. Further, and for example, the length of the rear face 120 may extend at any other angle than approximately perpendicular relative to the lengths of the circuit face 114 and/or the housing face 116; and the length of the rear face 120 may extend at any other angle than approximately parallel relative to the length of the connector face 112. Yet another example is that the length of the intermediate face 118 may extend at any other angle than approximately 135° relative to the housing face 116 and/or the rear face 120; and the length of the intermediate face 118 may extend at any other angle than approximately 45° relative to the connector face 112 and/or the circuit face 114. In some alternative embodiments, the housing face 116 intersects the rear face 120. For example, the body 110 of the support member 18 optionally does not include the intermediate face 118, or both the intermediate face 118 and the housing face 116 intersect the rear face 120. In some alternative embodiments, the body 110 of the support member 18 optionally does not include the rear face 120 and the circuit face 114 intersects the intermediate face 118 and/or the housing face 116.

The body 110 of the support member 18 may be fabricated from any materials. In the exemplary embodiment, the body 110 is fabricated from one or more dielectric materials, such as, but not limited to, a plastic, a polymer, and/or the like. In addition or alternatively, the body 110 may be fabricated from one or more electrically conductive materials and/or may include one or more electrical conductors thereon and/or therein. For example, in some alternative embodiments, the body 110 and/or one or more electrical conductors on and/or within the body 110 may provide an electrical connection between one or more of the electrical connectors 14 and the printed circuit 12.

FIG. 9 is a partially exploded perspective view of a portion of the connector assembly 10. The wall 40 of the housing 16 has been removed from the assembly 10 in FIG. 9 for clarity. FIG. 9 illustrates assembly of the support members 18 with the electrical connectors 14, the printed circuit 12, and the housing 16. The bottom side 80 of each of the electrical connectors 14 is mounted on the component surface 22 of the printed circuit 12. The slots 84 and the extension elements 85 of the electrical connectors 14 extend upward from the printed circuit 12. In the exemplary embodiment, each of the slots 84 and each of the extension elements 85 extends along an approximate entirety of the height H of the rear side 50 of the electrical connector 14. In other words, each slot 84 and extension element 85 extends from a respective top 168 and 170 that intersects a top side 172 of the electrical connector(s) 14 to a respective bottom 174 and 176 that intersects the component surface 22 of the printed circuit 12. In alternative embodiments wherein the respective bottom 174 and/or 176 of one or more of the slots 84 and/or one or more of the extension elements 85 does not intersect that components surface 22, the slot(s) 84 and/or the extension element(s) 85 are still considered to extend upwardly from the printed circuit 12.

Figure 10:
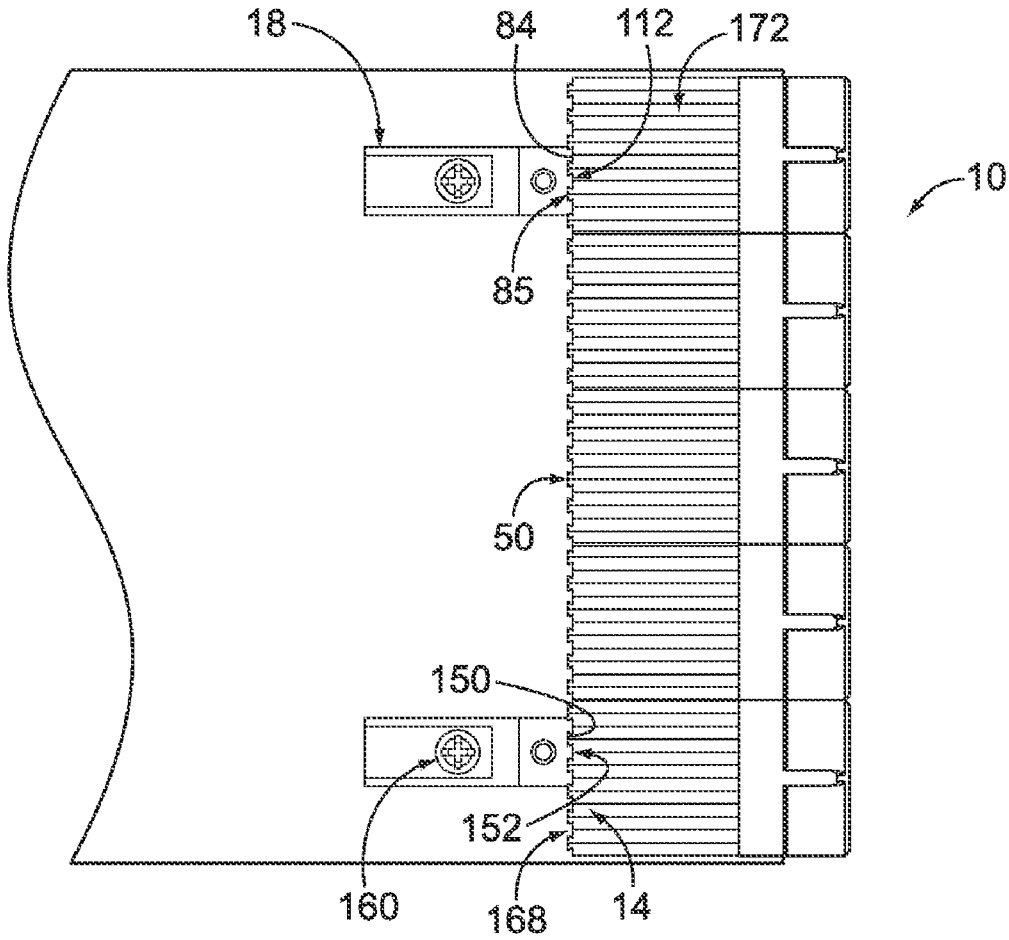
FIG. 10 is a top plan view of a portion of the connector assembly shown in FIG. 9.
Figure 11:
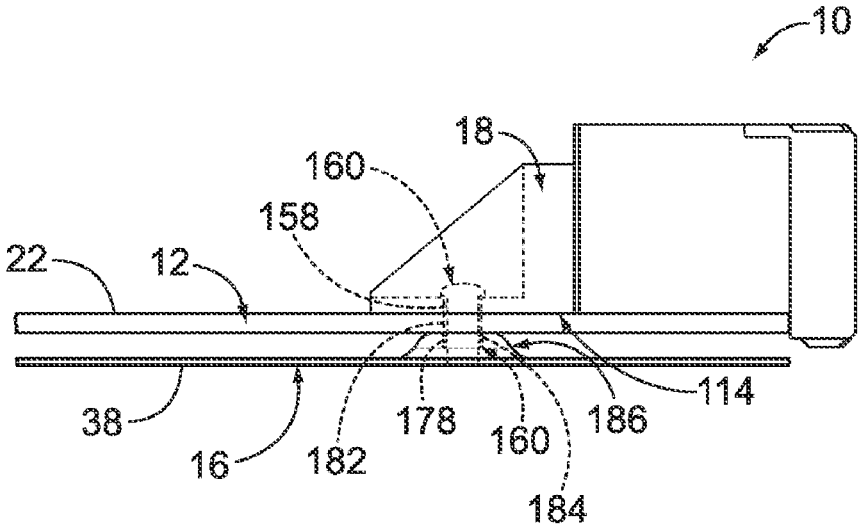
FIG. 11 is a side elevational view of the portion of the connector assembly shown in FIG. 9.

FIG. 10 is a top plan view of a portion of the assembly 10. Referring now to FIGS. 9 and 10, to assemble the support members 18 with the electrical connectors 14, each of the extension elements 152 of the support members 18 is slidably received within a corresponding one of the slots 84 of the electrical connectors 14. Similarly, some of the extension elements 85 of the electrical connectors 14 are slidably received within corresponding ones of the slots 150 of the support members 18. Via the reception of the extension elements 152 and 85 within the respective slots 84 and 150, the connector faces 112 of the support members 18 are thereby engaged with the rear sides 50 of the electrical connectors 14. In the exemplary embodiment, the extension elements 152 of the support members 18 are loaded into the slots 84 of the electrical connectors 14 from the top 168 in the direction of the arrow A (not shown in FIG. 10). But, in alternative embodiments wherein the top 168 of one or more of the slots 84 does not intersect the top side 172 of the corresponding electrical connector(s) 14, the extension elements 152 of one or more of the support members 18 may need to be loaded from the bottom 174 (not visible in FIG. 10) of the slots 84 before the corresponding electrical connector(s) 14 is mounted on the printed circuit 12.

In addition or alternative to the reception of the extension elements 85 and 152 within the respective slots 150 and 84, one or more of the connector faces 112 is optionally mechanically connected to the corresponding rear side(s) 50 using any connection element (not shown), such as, but not limited to, an adhesive, a threaded fastener, a non-threaded fastener, a snap-fit, and/or the like. In some embodiments, one or more of the connector faces 112 is engaged with the corresponding rear side(s) 50 in alternative to the slots 84 and 150, the extension elements 85 and 152, and the connection elements. In other words, in some embodiments the engagement between one or more of the connector faces 112 and the rear side 50 of the electrical connector(s) 14 is the only mechanical connection between the connector face(s) 112 and the rear side(s) 50 of the electrical connector(s) 14.

FIG. 11 is a side elevational view of the portion of the connector assembly 10 shown in FIG. 9. The circuit face 114 of each of the support members 18 is engaged with the component surface 22 of the printed circuit 12. In addition to the engagement with the component surface 22, one or more of the support members 18 is optionally mechanically connected to the printed circuit 12 and/or the wall 38 of the housing 16. In the exemplary embodiment, the support members 18 are each mechanically connected to the wall 38 of the housing 16 through the printed circuit 12. Specifically, the wall 38 of the housing 16 includes a threaded opening 178 extending therethrough. A threaded fastener 160 extends through the opening 158 within the support member 18 and through an opening 182 within the printed circuit 12. The threaded fastener 160 engages the threads 184 of the opening 178 to mechanically connect the support member 18 to the housing wall 38. The threaded fastener 160 can also be seen in FIG. 10. Optionally, the opening 178 of the housing wall 38 extends through an embossment 186 of the wall 38. The embossment 186 may facilitate electrically isolating the housing wall 38 from the printed circuit 12.

In addition or alternative to the opening 158, the opening 178, the opening 182, and/or the threaded fastener 160, one or more of the circuit faces 114 is optionally mechanically connected to the printed circuit 12 and/or the housing wall 38 using any other connection element (not shown), such as, but not limited to, an adhesive, a non-threaded fastener, a snap-fit, and/or the like. In some embodiments, one or more of the circuit faces 114 is engaged with the component surface 22 of the printed circuit 12 in alternative to the opening 158, the opening 178, the opening 182, the threaded fastener 160, and the other connection elements. In other words, in some embodiments the engagement between one or more of the circuit faces 114 and the component surface 22 is the only mechanical connection between the circuit face(s) 114 and the printed circuit 12 and/or the housing 16.

FIG. 12 is a partially exploded perspective view of the connector assembly 10. The housing face 116 of each of the support members 18 is engaged with the wall 40 of the housing 16. In addition to the engagement with the housing wall 40, one or more of the support members 18 is optionally mechanically connected to the housing wall 40. In the exemplary embodiment, the housing wall 40 includes one or more openings 188 extending therethrough. A threaded fastener 165 extends through each of the openings 188 within the housing wall 40 and into the opening 162 within the housing face 116 of the corresponding support member 18. The threaded fastener 165 engages the threads 164 (FIGS. 7 and 8) of the opening 162 to mechanically connect the support member 18 to the housing wall 40.

In addition or alternative to the opening 162, the opening 188, and/or the threaded fastener 165, one or more of the housing faces 116 is optionally mechanically connected to the housing wall 40 using any other connection element (not shown), such as, but not limited to, an adhesive, a non-threaded fastener, a snap-fit, and/or the like. In some embodiments, one or more of the housing faces 116 is engaged with the housing wall 40 in alternative to the opening 162, the opening 188, the threaded fastener 165, and the other connection elements. In other words, in some embodiments the engagement between one or more of the housing faces 116 and the housing wall 40 is the only mechanical connection between the housing face(s) 116 and the housing 16.

When engaged with the component surface 22 of the printed circuit 12 and the rear sides 50 of the electrical connectors 14, the support members 18 support the printed circuit 12 and the electrical connectors 14 during mating of the electrical connectors 14 with a mating connector (not shown). The mechanical connections between the support members 18 and the housing 16, the printed circuit 12, and/or the electrical connectors 14 may facilitate increasing an amount of support provided by the support members 18 and/or may facilitate an overall rigidity of the connector assembly 10, for example.

Although two are shown, the connector assembly 10 may include any number of the support members 18, each for engagement with the rear side(s) 50 of any number of the electrical connectors 14. Moreover, the connector assembly 10 may include any number of the electrical connectors 14, each of which may or may not be engaged by any number of the support members 18. In the exemplary embodiment, the electrical connectors 14 are mounted on the printed circuit 12 adjacent the mating edge 26 of the printed circuit 12. But, one or more of the electrical connectors 14 may be mounted at any location along the component surface 22 of the printed circuit 12 other than along the mating edge 26. The electrical connectors 14 shown and described herein are meant as exemplary only. The support members 18 may be used with any type of electrical connector that is mounted on a printed circuit.

Figure 13:
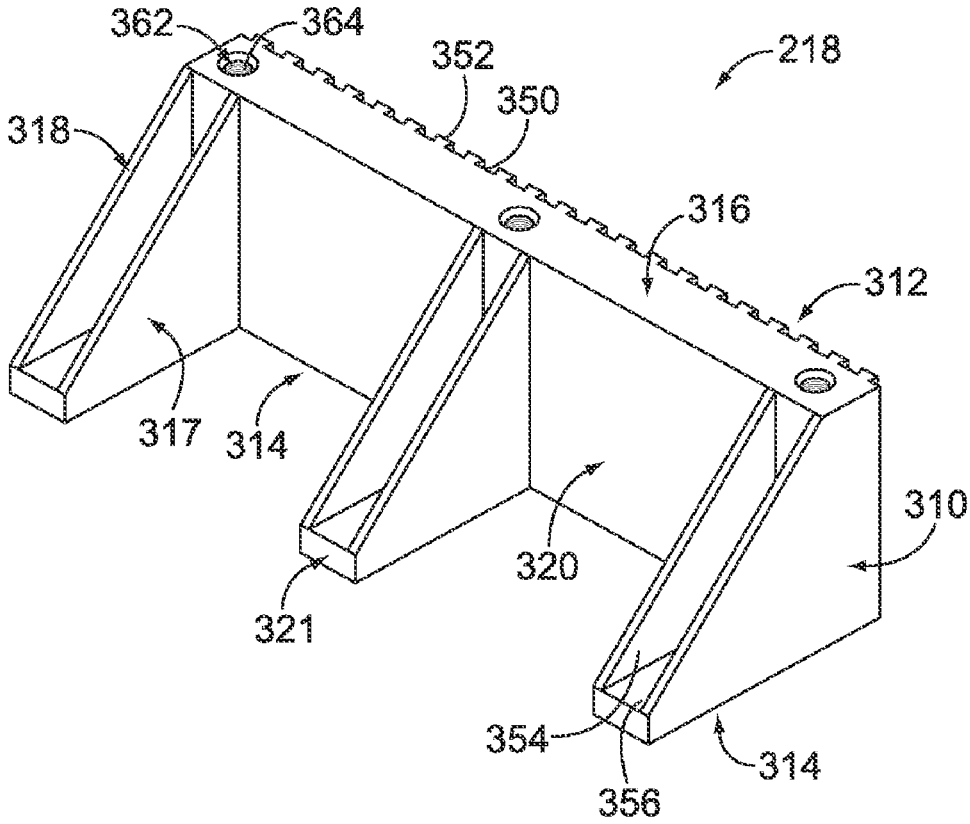
FIG. 13 is a perspective view of an exemplary alternative embodiment of a support member.
Figure 14:
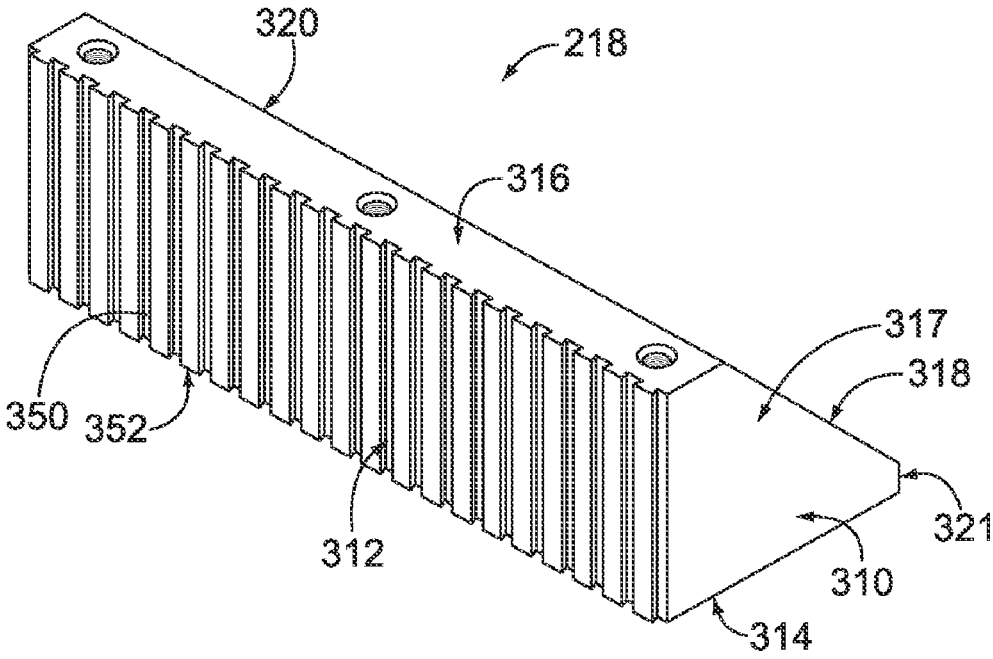
FIG. 14 is another perspective view of the support member shown in FIG. 13 viewed from a different angle than FIG. 13.

FIG. 13 is a perspective view of an exemplary alternative embodiment of a support member 218. FIG. 14 is another perspective view of the support member 218 viewed from a different angle than FIG. 13. Referring now to FIGS. 13 and 14, the support member 218 includes a body 310 having a connector face 312, a circuit face 314, a housing face 316, a rear face 320, and a plurality of gussets 317. The gussets 317 extend outwardly from the rear face 320 and define portions of the circuit face 314. Each gusset 317 also includes an intermediate face 318 and a rear face 321. The intermediate faces 318 extend from the housing face 316 to the rear faces 321, which extend between the intermediate faces 318 and the circuit face 314. The connector face 312 is configured to engage the rear side 50 (FIGS. 2, 9, and 10) of the electrical connector 14 (FIGS. 1, 2, 9, and 10), and the circuit face 314 is configured to engage the component surface 22 (FIGS. 1, 9, and 11) of the printed circuit 12 (FIGS. 1, 9, and 11).

The connector face 312 of the body 310 of the support member 218 includes one or more optional slots 350 for connection with the electrical connector 14. The slots 350 define optional extension elements 352 therebetween. In the exemplary embodiment, each of the slots 350 and each of the extension elements 352 extend along an approximate entirety of the length (defined from the circuit face 314 to the housing face 316) of the connector face 312. Alternatively, one or more of the slots 350 and/or one or more of the extension elements 352 extends along only a portion of the length of the connector face 312. In the exemplary embodiment, the slots 350 include a wedge shape. But, in addition or alternatively to the exemplary shapes shown and/or described herein, each of the slots 350 may include any other shape. Each of the extension elements 352 may also include any other shape than is shown and/or described herein. One or more of the slots 350 optionally includes a complementary shape relative to a corresponding one of the extension elements 85 (FIGS. 2, 9, and 10) of the electrical connector 14. Similarly, one or more of the extension elements 352 optionally includes a complementary shape relative to a corresponding one of the slots 84 (FIGS. 2, 9, and 10) of the electrical connector 14. The connector face 312 may include any number of the slots 350 and any number of the extension elements 352.

Referring now to FIG. 13, the intermediate faces 318 of the gussets 317 include an optional recess 354 extending therethrough. In some alternative embodiments, one or more of the recesses 354 extends through a portion of the corresponding rear face 321. The recess 354 includes a bottom 356. One or more of the gussets 317 includes one or more optional openings (not shown) that extend through the bottom 356 of the recess 354, through the circuit face 314, and completely through gusset 317 between the bottom 356 and the circuit face 314. The opening is configured to receive a fastener (such as, but not limited to, the fastener 160 shown in FIGS. 10 and 11) therethrough for connecting the support member 218 to the wall 38 (FIGS. 1 and 11) of the housing 16 (FIGS. 1, 9, 11, and 12) of the electrical connector 14. Optionally, one or more of the gussets 317 of the support member 218 does not include the recess 354 and the opening extends through the corresponding intermediate face 318.

The support member 218 includes one or more optional openings 362 that extend through the housing face 316 and into a portion of the body 310. In the exemplary embodiment, the opening 362 includes a thread 364 for connection to the housing 16 using a threaded fastener (such as, but not limited to, the fastener 165 shown in FIG. 12). In some alternative embodiments, the opening 362 extends completely through the body 310 for connecting the support member 218 to the wall 38 of the housing 16 using a fastener (not shown) that extends through the opening 362. The connection between the support member 218 and the wall 38 of the housing 16 using the opening 362 may be an additional or alternative connection to any connection between the support member 218 and the wall 38 described and/or illustrated herein, such as, but not limited to, the connection between the support member 218 and the wall 38 using the openings that extend through the gussets 317. Although three openings 362 are shown, the support member 218 may include any number of the openings 362.

In addition or alternatively to the exemplary sizes and shapes shown and/or described herein, the body 310 of the support member 218 may include any other shapes that enable the body 310 to engage both the component surface 22 of the printed circuit 12 and the rear side 50 of the electrical connector 14. For example, in the exemplary embodiment, the connector face 312 and the circuit face 314 extend approximately perpendicular to each other. Alternatively, the connector face 312 and the circuit face 314 may extend at any other angle than approximately perpendicular relative to each other. The housing face 316 extends approximately perpendicular to the connector face 312 and approximately parallel to the circuit face 314 in the exemplary embodiment. But, the housing face 316 may extend at any other angle than approximately perpendicular relative to the connector face 312; and the housing face 316 may extend at any other angle than approximately parallel relative to the circuit face 314. Although the rear face 320 is shown as extending approximately perpendicular to the circuit face 314 and the housing face 316, the rear face 320 may extend at any other angle than approximately perpendicular relative to the circuit face 314 and/or the housing face 316. Moreover, and for example, the rear face 320 may extend at any other angle than approximately parallel relative to the connector face 312.

In the exemplary embodiment, the rear faces 321 of the gussets 317 extend approximately perpendicular to the circuit face 314 and the housing face 316, and extend approximately parallel to the connector face 312. But, each of the rear faces 321 may extend at any other angle than approximately perpendicular relative to the circuit face 314 and/or the housing face 316. Moreover, and for example, each of the rear faces 321 may extend at any other angle than approximately parallel relative to the connector face 312. In the exemplary embodiment, the intermediate faces 318 of the gussets 317 extend at an approximately 135° angle relative to the housing face 316 and the rear face 320, and thus extend at an approximately 45° angle relative to the connector face 312 and the circuit face 314. But, each of the intermediate faces 318 may extend at any other angle than approximately 135° relative to the housing face 316 and/or the rear face 320; and each of the intermediate faces 318 may extend at any other angle than approximately 45° relative to the connector face 312 and/or the circuit face 314. In some alternative embodiments, the housing face 316 intersects one or more of the rear faces 121. For example, the body 310 of the support member 218 optionally does not include the intermediate face 318 of one or more of the gussets 317, or both the housing face 316 and the intermediate face 318 of one or more of the gussets 317 intersect the corresponding rear face 121. In some alternative embodiments, one or more of the gussets 317 optionally does not include the rear face 121 and the circuit face 114 intersects the corresponding intermediate face 318 and/or the housing face 316.

In addition or alternative to the reception of the extension elements 85 and 352 within the respective slots 350 and 84, the connector face 312 is optionally mechanically connected to the rear side(s) 50 using any connection element (not shown), such as, but not limited to, an adhesive, a threaded fastener, a non-threaded fastener, a snap-fit, and/or the like. In some embodiments, the connector face 312 is engaged with the rear side(s) 50 in alternative to the slots 84 and 350, the extension elements 85 and 352, and the connection elements. In other words, in some embodiments the engagement between the connector face 312 and the rear side(s) 50 of the electrical connector(s) 14 is the only mechanical connection between the connector face 312 and the rear side(s) 50 of the electrical connector(s) 14. In addition or alternative to one or more of the openings within the gussets 317, one or more of the openings 178, one or more of the openings 182, and/or one or more of the threaded fasteners 160, the circuit face 314 is optionally mechanically connected to the printed circuit 12 and/or the housing wall 38 using any other connection element (not shown), such as, but not limited to, an adhesive, a non-threaded fastener, a snap-fit, and/or the like. In some embodiments, the circuit face 314 is engaged with the component surface 22 of the printed circuit 12 in alternative to the openings within the gussets 317, the openings 178, the openings 182, the threaded fasteners 160, and the other connection elements. In other words, in some embodiments the engagement between the circuit face 314 and the component surface 22 is the only mechanical connection between the circuit face 314 and the printed circuit 12 and/or the housing 16. In addition or alternative to one or more of the openings 362, one or more of the openings 188, and/or one or more of the threaded fasteners 165, the housing face 316 is optionally mechanically connected to the housing wall 40 using any other connection element (not shown), such as, but not limited to, an adhesive, a non-threaded fastener, a snap-fit, and/or the like. In some embodiments, the housing face 316 is engaged with the housing wall 40 in alternative to the openings 362, the openings 188, the threaded fasteners 165, and the other connection elements. In other words, in some embodiments the engagement between the housing face 316 and the housing wall 40 is the only mechanical connection between the housing face 316 and the housing 16.

The body 310 of the support member 218 may be fabricated from any materials. In the exemplary embodiment, the body 310 is fabricated from one or more dielectric materials, such as, but not limited to, a plastic, a polymer, and/or the like. In addition or alternatively, the body 310 may be fabricated from one or more electrically conductive materials and/or may include one or more electrical conductors thereon and/or therein. For example, in some alternative embodiments, the body 310 and/or one or more electrical conductors on and/or within the body 310 may provide an electrical connection between one or more of the electrical connectors 14 and the printed circuit 12.

Figure 15:
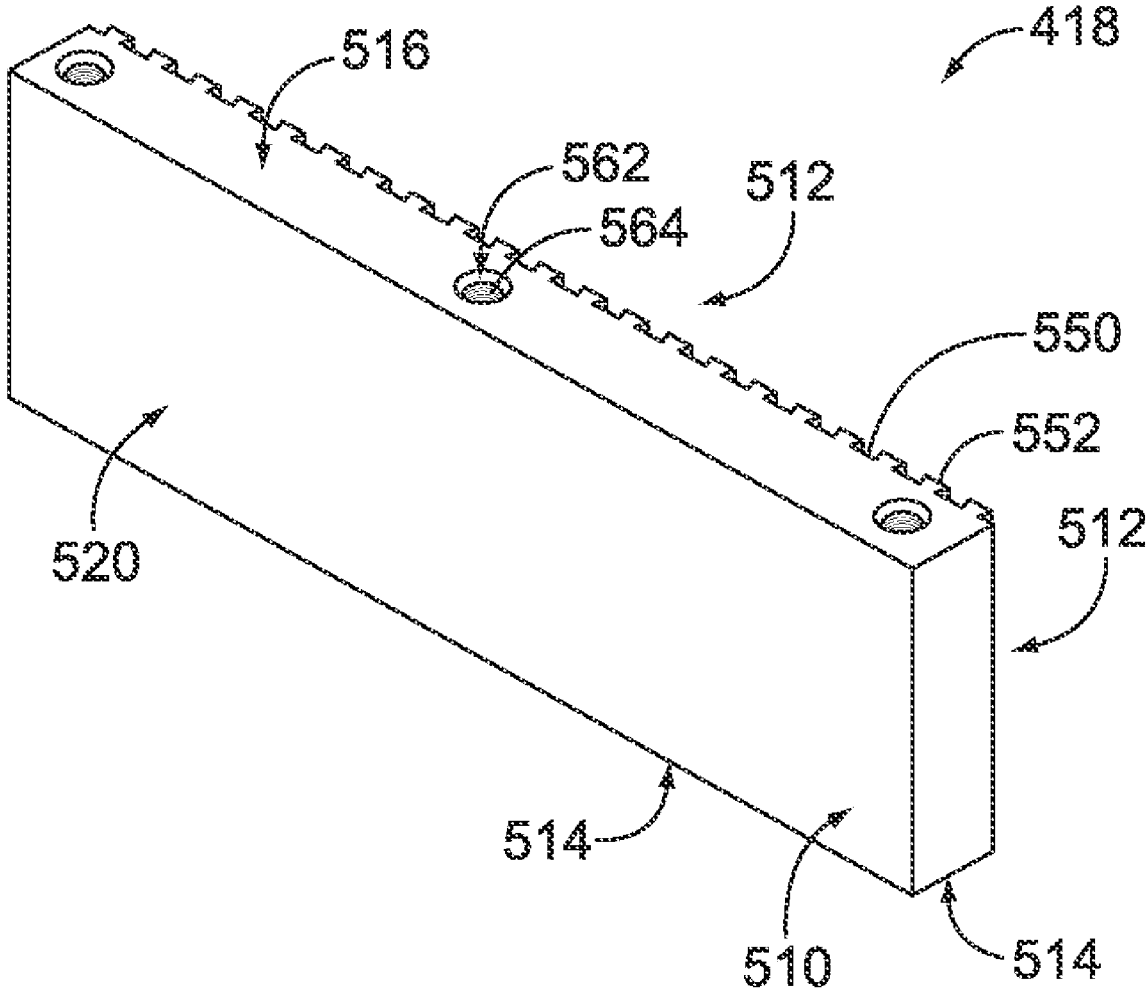
FIG. 15 is a perspective view of another exemplary alternative embodiment of a support member.

Although three are shown, the body 310 of the support member 218 may include any number of the gussets 317. In some embodiments, the body 310 of the support member 218 does not include any of the gussets 317. For example, FIG. 15 is a perspective view of an exemplary alternative embodiment of a support member 418. The support member 418 includes a body 510 having a connector face 512, a circuit face 514, a housing face 516, and a rear face 520. The connector face 512 is configured to engage the rear side 50 (FIGS. 2, 9, and 10) of the electrical connector 14 (FIGS. 1, 2, 9, and 10), and the circuit face 514 is configured to engage the component surface 22 (FIGS. 1, 9, and 11) of the printed circuit 12 (FIGS. 1, 9, and 11).

The connector face 512 of the body 510 of the support member 418 includes one or more optional slots 550 for connection with the electrical connector 14. The slots 550 define optional extension elements 552 therebetween. In the exemplary embodiment, each of the slots 550 and each of the extension elements 552 extend along an approximate entirety of the length (defined from the circuit face 514 to the housing face 516) of the connector face 512. Alternatively, one or more of the slots 550 and/or one or more of the extension elements 552 extends along only a portion of the length of the connector face 512. In the exemplary embodiment, the slots 550 include a wedge shape. But, in addition or alternatively to the exemplary shapes shown and/or described herein, each of the slots 550 may include any other shape. Each of the extension elements 552 may also include any other shape than is shown and/or described herein. One or more of the slots 550 optionally includes a complementary shape relative to a corresponding one of the extension elements 85 (FIGS. 2, 9, and 10) of the electrical connector 14. Similarly, one or more of the extension elements 552 optionally includes a complementary shape relative to a corresponding one of the slots 84

(FIGS. 2, 9, and 10) of the electrical connector 14. The connector face 512 may include any number of the slots 550 and any number of the extension elements 552.

The support member 418 includes one or more optional openings 562 that extend through the housing face 516 and into a portion of the body 510. In the exemplary embodiment, the opening 562 includes a thread 564 for connection to the housing 16 using a threaded fastener (such as, but not limited to, the fastener 165 shown in FIG. 12). In some alternative embodiments, the opening 562 extends completely through the body 510 for connecting the support member 418 to the wall 38 (FIGS. 1 and 11) of the housing 16 using a fastener (not shown) that extends through the opening 562. Although three openings 362 are shown, the support member 218 may include any number of the openings 362.

In addition or alternatively to the exemplary sizes and shapes shown and/or described herein, the body 510 of the support member 418 may include any other shapes that enable the body 510 to engage both the component surface 22 of the printed circuit 12 and the rear side 50 of the electrical connector 14. For example, in the exemplary embodiment, the connector face 512 and the circuit face 514 extend approximately perpendicular to each other. Alternatively, the connector face 512 and the circuit face 514 may extend at any other angle than approximately perpendicular relative to each other. The housing face 516 extends approximately perpendicular to the connector face 512 and approximately parallel to the circuit face 514 in the exemplary embodiment. But, the housing face 516 may extend at any other angle than approximately perpendicular relative to the connector face 512; and the housing face 516 may extend at any other angle than approximately parallel relative to the circuit face 514. Although the rear face 520 is shown as extending approximately perpendicular to the circuit face 514 and the housing face 516, the rear face 520 may extend at any other angle than approximately perpendicular relative to the circuit face 514 and/or the housing face 516. Moreover, and for example, the rear face 520 may extend at any other angle than approximately parallel relative to the connector face 512.

In addition or alternative to the reception of the extension elements 85 and 552 within the respective slots 550 and 84, the connector face 512 is optionally mechanically connected to the rear side(s) 50 using any connection element (not shown), such as, but not limited to, an adhesive, a threaded fastener, a non-threaded fastener, a snap-fit, and/or the like. In some embodiments, the connector face 512 is engaged with the rear side(s) 50 in alternative to the slots 84 and 550, the extension elements 85 and 552, and the connection elements. In other words, in some embodiments the engagement between the connector face 512 and the rear side(s) 50 of the electrical connector(s) 14 is the only mechanical connection between the connector face 512 and the rear side(s) 50 of the electrical connector(s) 14. The circuit face 514 is optionally mechanically connected to the printed circuit 12 and/or the housing wall 38 using any connection element (not shown), such as, but not limited to, an adhesive, a non-threaded fastener, a threaded fastener, a snap-fit, and/or the like. In some embodiments the engagement between the circuit face 514 and the component surface 22 is the only mechanical connection between the circuit face 514 and the printed circuit 12 and/or the housing 16. In addition or alternative to one or more of the openings 562, one or more of the openings 188, and/or one or more of the threaded fasteners 165, the housing face 516 is optionally mechanically connected to the housing wall 40 using any other connection element (not shown), such as, but not limited to, an adhesive, a non-threaded fastener, a snap-fit, and/or the like. In some embodiments, the housing face 516 is engaged with the housing wall 40 in alternative to the openings 562, the openings 188, the threaded fasteners 165, and the other connection elements. In other words, in some embodiments the engagement between the housing face 516 and the housing wall 40 is the only mechanical connection between the housing face 516 and the housing 16.

The body 510 of the support member 418 may be fabricated from any materials. In the exemplary embodiment, the body 510 is fabricated from one or more dielectric materials, such as, but not limited to, a plastic, a polymer, and/or the like. In addition or alternatively, the body 510 may be fabricated from one or more electrically conductive materials and/or may include one or more electrical conductors thereon and/or therein. For example, in some alternative embodiments, the body 510 and/or one or more electrical conductors on and/or within the body 510 may provide an electrical connection between one or more of the electrical connectors 14 and the printed circuit 12.

The embodiments described and/or illustrated herein may provide a support member that facilitates reducing an amount a printed circuit flexes and/or an amount of stress applied to a printed circuit during mating with a mating connector. The embodiments described and/or illustrated herein may provide a support member that occupies less space within a mating area of a connector assembly than at least some known support members. The embodiments described and/or illustrated herein may provide a connector assembly having an increased number and/or size of electrical connectors mounted on a printed circuit. The embodiments described and/or illustrated herein may provide a support member that facilitate preventing an electrical connector from being electrically disconnected from a printed circuit.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a printed circuit having a component surface and a bottom surface that is opposite the component surface;

a housing having a wall extending along the bottom surface of the printed circuit;

an electrical connector having a bottom side mounted on the component surface of the printed circuit, the electrical connector extending a length from a mating face to a rear side that is opposite the mating face, the electrical connector being configured to mate with a mating connector at the mating face; and a support member comprising a body having a connector face and a circuit face, the support member positioned such that the connector face engages the rear side of the electrical connector and the circuit face engages the component surface of the printed circuit to support the electrical connector on the printed circuit, wherein the support member is mechanically connected through the printed circuit to the wall of the housing.

2. The assembly according to claim 1, wherein the rear side of the electrical connector comprises a slot extending upward from the printed circuit, the connector face of the support member comprising an extension element slidably received within the slot of the rear side of the electrical connector.

3. The assembly according to claim 1, wherein the housing has another wall covering at least a portion of the component surface of the printed circuit, the support member comprising a housing face extending from at least one of the connector face and the circuit face, the support member being mechanically connected to the other wall of the housing at the housing face.

4. The assembly according to claim 1, wherein the rear side of the electrical connector comprises a slot, the connector face of the support member comprising a wedge element received within the slot of the rear side of the electrical connector.

5. The assembly according to claim 1, wherein the body of the support member comprises an opening extending therethrough, the assembly further comprising a fastener received within the opening and extending through the printed circuit.

6. The assembly according to claim 1, wherein the body of the support member comprises an opening extending therethrough, the assembly further comprising a fastener received within the opening and engaged with the housing.

7. The assembly according to claim 1, wherein the circuit face of the support member extends approximately perpendicular to the connector face.

8. The assembly according to claim 1, wherein the housing is an assembly housing and the electrical connector comprises a connector housing and contact modules held by the connector housing, the contact modules defining at least a portion of the bottom side of the electrical connector.

9. The assembly according to claim 1, wherein the mating face of the electrical connector extends approximately perpendicular to the component surface of the printed circuit.

10. A connector assembly comprising:

a printed circuit having a component surface;

an electrical connector having a bottom side mounted on the component surface of the printed circuit, the electrical connector extending a length from a mating face to a rear side that is opposite the mating face, the electrical connector being configured to mate with a mating connector at the mating face, wherein the electrical connector comprises a housing and contact modules held by the housing, the contact modules defining at least a portion of the rear side of the electrical connector, the rear side of the electrical connector comprising a wedge-shaped slot defined by two adjacent contact modules; and a support member comprising a body having a connector face and a circuit face, the support member positioned such that the connector face engages the rear side of the electrical connector and the circuit face engages the component surface of the printed circuit to support the electrical connector on the printed circuit, the connector face of the support member comprising an extension received within the slot of the electrical connector.

* * * * *